US008231438B2

(12) United States Patent
Kuhnle et al.

(10) Patent No.: US 8,231,438 B2
(45) Date of Patent: Jul. 31, 2012

(54) ELECTRIC HAND-HELD POWER TOOL

(75) Inventors: Axel Kuhnle, Freiberg A. N. (DE); Justus Lamprecht, Dusslingen (DE); Joerg Lemmel, Weinstadt (DE); Steffen Tiede, Herrenberg (DE); Ulrich Bohne, Kohlberg (DE); Dietmar Saur, Gomaringen (DE)

(73) Assignee: Robert Bosch GmbH, Stuttgart (DE)

( * ) Notice: Subject to any disclaimer, the term of this patent is extended or adjusted under 35 U.S.C. 154(b) by 1057 days.

(21) Appl. No.: 12/160,254

(22) PCT Filed: May 4, 2007

(86) PCT No.: PCT/EP2007/054358

§ 371 (c)(1),
(2), (4) Date: Jul. 8, 2008

(87) PCT Pub. No.: WO2008/003540

PCT Pub. Date: Jan. 10, 2008

(65) Prior Publication Data

US 2009/0068936 A1 Mar. 12, 2009

(30) Foreign Application Priority Data

Jul. 3, 2006 (DE) ..... 10 2006 030 559

(51) Int. Cl.
*B24B 23/02* (2006.01)

(52) U.S. Cl. ..... 451/359

(58) Field of Classification Search ..... 451/359
See application file for complete search history.

(56) References Cited

U.S. PATENT DOCUMENTS

| | | | | |
|---|---|---|---|---|
| 3,040,485 | A | 6/1962 | Tocci-Guilbert | |
| 3,561,462 | A * | 2/1971 | Jugler | 173/199 |
| 4,905,772 | A * | 3/1990 | Honsa et al. | 173/162.1 |
| 6,464,572 | B2 * | 10/2002 | Jansson | 451/344 |
| 2008/0003929 | A1 * | 1/2008 | Degen | 451/359 |

FOREIGN PATENT DOCUMENTS

| | | |
|---|---|---|
| CN | 2095965 | 2/1992 |
| CN | 2651452 | 10/2004 |
| GB | 1 311 161 | 3/1973 |
| JP | 560163882 | 12/1981 |
| SU | 946 906 | 7/1982 |
| SU | 1834788 | 8/1993 |
| WO | 2006/058898 | 6/2006 |

* cited by examiner

*Primary Examiner* — Maurina Rachuba
(74) *Attorney, Agent, or Firm* — Michael J. Striker

(57) ABSTRACT

The invention relates to a hand-held electric power tool comprising at least one driven rotating part (3) that is mounted in at least one bearing (7, 13). According to the invention, the rotating part (3) is vibrationally decoupled from the bearing (7, 13).

3 Claims, 5 Drawing Sheets

ELECTRIC HAND-HELD POWER TOOL

The present invention relates to an electric hand-held power tool with at least one driven, rotating part that is supported in at least one bearing.

RELATED ART

An electric hand-held power tool of this type is known. It is an electric hand-held power tool whose tool is driven in a rotating manner. The electric hand-held power tool is, e.g., a sanding or polishing tool, whose tool is designed as a sanding or polishing disk. The rotating part is a rotating element of the electric hand-held power tool that is located in a drive train between the tool and the bearing, or it is the tool itself, or a tool element of the tool. In the context of the present invention, the term "rotating part" does not mean that the rotating part must be an element that is created on a lathe. When working with an electric hand-held power tool of this type that includes a rotating part, vibrations of various intensities may occur. These vibrations result primarily from an imbalance of the tool, which is rotating at a high rotational speed, and from the machining of a work piece with the tool. The vibrations are transferred via the bearing to the housing and via the handles to the operator of the electric hand-held power tool. These vibrations are bothersome to the operator and may result in injury to the operator if he uses the electric hand-held power tool for an extended period of time.

DISCLOSURE OF THE INVENTION

The inventive electric hand-held power tool includes a rotating part that is vibration-decoupled from the bearing. The rotating part of the electric hand-held power tool is a rotating element that is located between a tool of the electric hand-held power tool and the bearing, or it is the tool itself. It serves to transfer torque from the drive to a machining region of a tool that is assigned to the electric hand-held power tool. The rotating part and the bearing are assigned to each other, but they need not interact directly. The rotating part that is supported in a bearing may also be supported in the bearing, e.g., using intermediate elements. By decoupling the vibrations between the rotating part and the bearing, the vibrations that are absorbed by the tool are transmitted further to the bearing and, therefore, to the housing, having been damped considerably. Due to the decoupling of vibrations, these vibrations are not transferred to the operator.

It is advantageously provided that the rotating part is a spindle. The spindle is a drive spindle for rotationally driving the tool.

It is provided, in particular, that the rotating part is a tool assigned to the electric hand-held power tool. If the rotating part is the tool itself, this tool is connected with the drive of the electric hand-held power tool via at least one drive element. The decoupling of vibrations may take place, e.g., via this drive element.

It is also provided that the rotating part is a tool element. When the tool includes an element for decoupling vibrations, the tool element is the part of the tool that is vibration-decoupled from the parts that are connected with the bearing. This tool element is the rotating part.

According to a refinement of the present invention, it is provided that the rotating part is vibration-decoupled from the bearing via at least one vibration-damping element. When the rotating part is, e.g., a spindle that serves to drive the tool, it may be connected with the bearing via the vibration-damping element. To this end, the spindle is enclosed, e.g., in an axial region and circumferentially by a vibration-damping element located in the bearing.

In addition, at least one intermediate element is provided, which is located between the bearing and the rotating part. The intermediate element is, in particular, an intermediate element that serves to drive the rotating part. It is not necessarily vibration-decoupled from the bearing.

It is advantageously provided that the intermediate element is a transmission element, in particular a crown wheel, of a transmission. The transmission may, e.g., define a gear ratio, or if it is designed as a mitre gear, it may connect a motor with a drive spindle, with the spindle axis and the motor axis extending perpendicularly to each other. With a mitre gear of this type, a bevel-gear wheel in particular interacts with a crown wheel.

According to a refinement of the present invention, it is provided that the intermediate element is a spindle. The intermediate element, which is designed as a spindle, serves to transfer torque from the drive to the rotating part, which is a tool, for example. Unlike the rotating part, the intermediate element itself is not necessarily vibration-decoupled from the bearing.

It is furthermore provided that the vibration-damping element is located between the bearing and the rotating part and/or between the intermediate element and the rotating part and/or between the bearing and the intermediate element. Since the vibration-damping element decouples the vibrations between the rotating part and the bearing, it is possible to place the vibration-damping element in these various locations. The vibration-damping element may be located directly between the bearing and the rotating part. If an additional intermediate element is also provided, and if the bearing, intermediate element, and rotating part are located in series, the vibration-damping element may be located between the intermediate element and the rotating part, or between the bearing and the intermediate element. If several bearings and/or several vibration-damping elements are provided, combinations of these elements may also be provided.

In addition, at least two intermediate elements are provided, between which the vibration-damping element is located. With a design of this type, the rotating part is vibration-decoupled from the bearing by a vibration-damping element, which is not connected with the rotating part or the bearing.

It is advantageously provided that the vibration-damping element is a damping-spring device and/or a knitted fabric and/or an inherently elastic, vibration-damping element and/or a fluid vibration-damping element. The damping-spring device includes at least one spring element and a damping device. The spring element may be, e.g., a leaf spring, a coiled spring, a disk spring, or any other type of spring. The vibration-damping device may be integrally incorporated in the spring element. The knitted fabric is composed of meshed elements that are not rigid relative to each other but rather have a certain amount of play relative to each other. This play is determined by the density of the knitted fabric. The inherently elastic, vibration-damping element is composed of an elastically deformable material. The fluid, vibration-damping element is composed, e.g., of a damping cushion with an elastic sleeve and a filling that is a gel and/or a fluid and/or a gas.

It is further provided that the material of the damping-spring device and/or the knitted fabric is metal and/or plastic. The metal is a ferrous metal in particular, e.g., steel. The plastics are, e.g., thermoplastics, thermosetting compositions, elastomers, or material combinations of different materials.

In particular, it is provided that the inherently elastic, vibration-damping element is an elastomeric element. Elastomeric materials have good properties of inherent elasticity, they are easily shaped, and they may be combined with other materials via vulcanizing.

It is further provided that the vibration-damping element is located, as a coupling device, between the crown wheel and the spindle, and that it transfers a torque. When the spindle is driven via a transmission with a crown wheel, the crown wheel is supported in a bearing that is assigned to the crown wheel. As an alternative, the crown wheel may also be supported in several bearings. The vibration-damping element, which is designed as the coupling device, is located between the crown wheel and the spindle, and it performs two functions: It serves to decouple vibrations between the spindle and the bearing, in which case the spindle is the rotating part, or the rotating part with the spindle is vibration-decoupled from the bearing. The vibration-damping element serves simultaneously as a coupling device and serves to transfer torque from the crown wheel of the transmission to the spindle. The vibration-damping element connects the crown wheel with the spindle in a non-positive manner. A form-fit connection of the crown wheel and the spindle via the vibration-damping element limits the freedom of motion between the crown wheel and the spindle.

According to a refinement of the present invention, it is provided that the coupling device is a corrugated washer sleeve that engages in recesses in the crown wheel and encloses the spindle, or a sleeve that encloses the spindle and includes at least one spring tab that engages in a recess in the crown wheel, or a spring device with at least one spring-loaded ball. These three alternative embodiments of the coupling device each provide for a form-fit and non-positive connection between the spindle and the crown wheel, while the coupling device serves simultaneously to decouple vibrations.

It is advantageously provided that the vibration-damping element is mounted on the tool. With a tool that is detachably connected to an intermediate element, the vibration-damping element may be attached directly to the tool. This has the advantage that, when the tool is replaced, the vibration-damping element is also replaced. The vibration-damping element may be attached, e.g., to a shank of the tool. As an alternative, the vibration-damping element may also be integrated in the tool. In this case, the rotating part is the tool element in particular.

It is provided—as an alternative or in addition—that the vibration-damping element is mounted on the spindle or the crown wheel. To this end, the vibration-damping element may be located, e.g., between the spindle and a crown wheel, which encloses an axial region of the spindle. The vibration-damping element is designed as a coupling device. It encloses the spindle in an axial region and simultaneously provides a form-fit and non-positive connection between the vibration-damping element and the crown wheel, and it serves to decouple vibrations between the crown wheel and the spindle.

Finally, it is provided that the vibration-damping element is attached to a fastening device, which serves to detachably attach the tool and the spindle. A fastening device of this type may be composed, e.g., of a clamping flange and a locknut, each of which includes a vibration-damping element that is attached via spray application.

BRIEF DESCRIPTION OF THE DRAWING

The present invention is explained with reference to the figures, as follows.

EMBODIMENT(S) OF THE INVENTION

Figure 1:
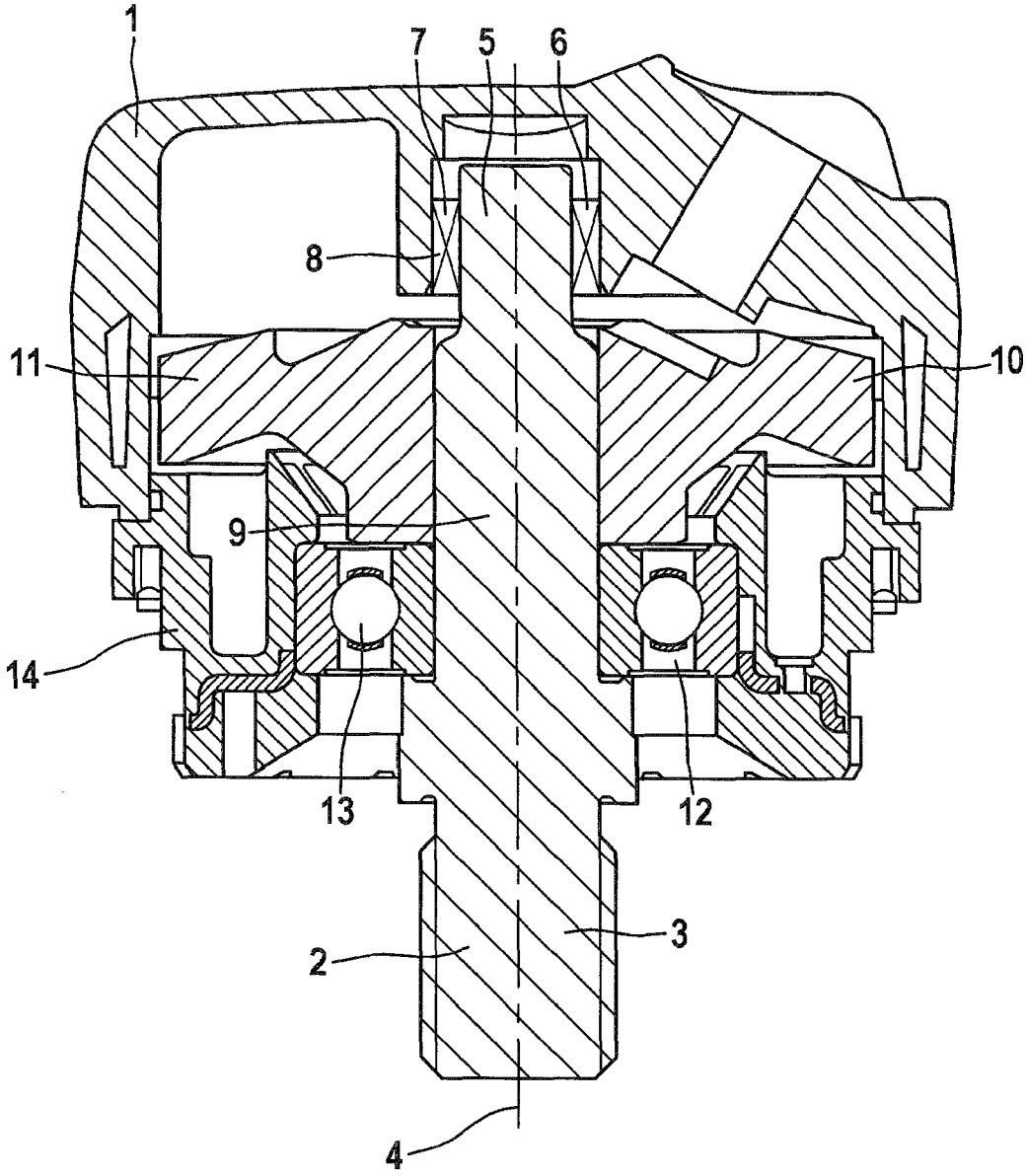
FIG. 1 shows a non-inventive support of a rotating part designed as a spindle.

FIG. 1 shows a part of non-inventive electric hand-held power tool designed as an angle grinder. A rotating part 3 designed as a spindle 2 and having a longitudinal axis 4 is located in a transmission housing 1. Spindle 2 is supported at one end 5 in a bearing 7, which is designed as a spindle bearing 6. Spindle bearing 6 is designed as a sliding bearing 8. As an alternative, spindle bearing 6 may also be designed as a needle roller bearing or a ball bearing. In the region of a central section 9 of longitudinal axis 4, spindle 2 is enclosed radially by a transmission unit 11 designed as a crown wheel 10. Crown wheel 10 is pressed onto spindle 2 in central section 9, and it is fixedly connected therewith. A bearing 13 designed as a ball bearing 12 is pressed onto spindle 2 next to crown wheel 10 on spindle 2, relative to longitudinal axis 4. In its outer region, ball bearing 12 is fixedly connected with a bearing flange 14 that encloses ball bearing 12 radially. Bearing flange 14 is connected with transmission housing 1. With the electric hand-held power tool shown in FIG. 1, rotating part 3 is not vibration-decoupled from bearing 7, 13.

Figure 2:
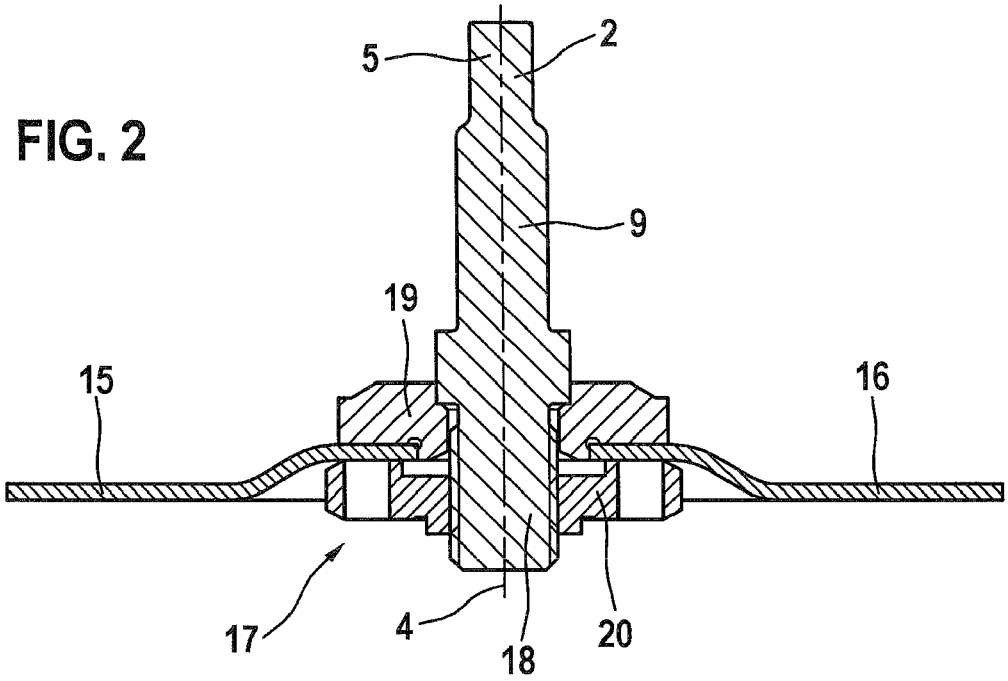
FIG. 2 shows a non-inventive attachment of a tool with the spindle in FIG. 1.

FIG. 2 shows the connection of rotating part 3 in FIG. 1, which is designed as spindle 2, with a tool 16 designed as a grinding disk 15. The connection between spindle 2 and tool 16 is established via a fastening device 17 at an end 18 of spindle 2 opposite to end 5. Fastening device 17 is composed of a fastening flange 19 and a locknut 20, which is located opposite to fastening flange 19 on the tool side, and which serves to attach the grinding disk via clamping.

FIGS. 1 and 2 also show, in combination, a non-inventive support of rotating part 3. If rotating part 3 is formed not by spindle 2, but by tool 16, spindle 3 in FIG. 1 is merely an intermediate element 21 located between rotating part 3—which is designed as tool 16—and bearings 7, 13. Since tool 16 is not vibration-decoupled from spindle 2, rotating part 3—which is designed as tool 16 and is shown in FIGS. 1 and 2—is not vibration-decoupled from bearing 7, 13, either.

Figure 3:
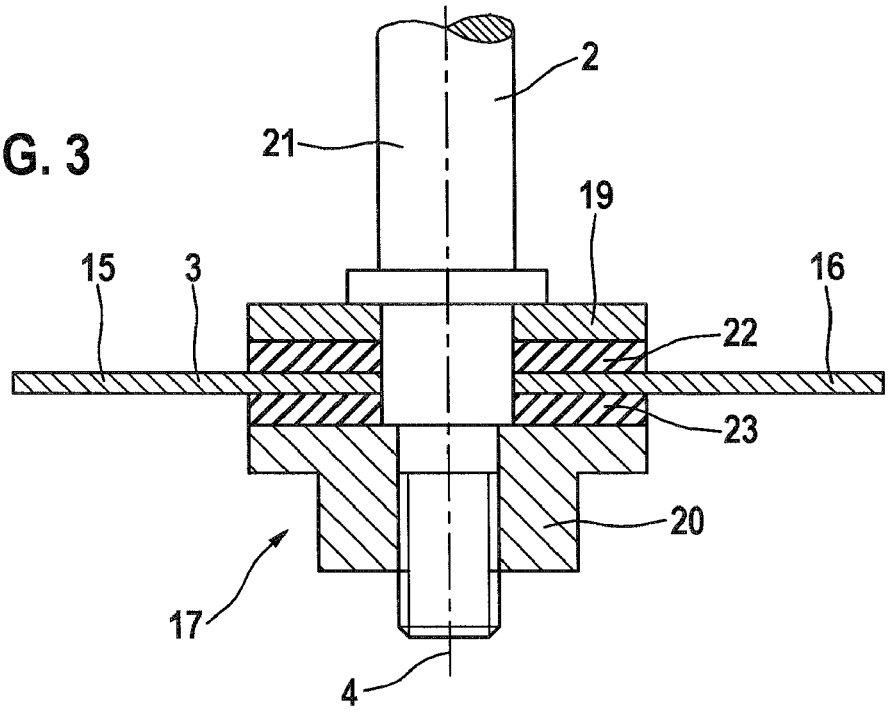
FIG. 3 shows an inventive configuration of vibration-damping elements between a tool and a spindle.

FIGS. 3 through 10C show configurations, according to the present invention, for the vibration-decoupling of rotating part 3 from bearing 7, 13. FIG. 3 shows the vibration-decoupling of rotating part 3, which is designed as tool 16, from a not-shown bearing of spindle 2. FIG. 3 is essentially similar to FIG. 2, so only the differences will be discussed here. Fastening device 17 includes two vibration-damping elements 22, 23 for the vibration-decoupling of rotating part 3, which is designed as tool 16, from intermediate element 21, which is designed as spindle 2. Tool 16, which is designed as grinding disk 15, is clamped in a known manner for installation, with the difference being that at least one vibration-damping element 22, 23 is located between fastening flange 19 and locknut 20. Vibration-damping element 22, 23 may be inserted as a separate vibration-damping element, or it may be fixedly attached to locknut 20 and/or fastening flange 19. To this end, fixed vibration-damping element 22, 23 may be sprayed onto locknut 20 and/or fastening flange 18.

Figure 4:
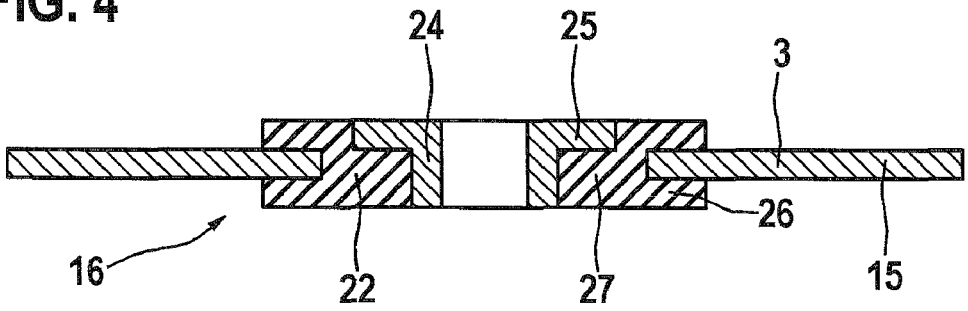
FIG. 4 shows a vibration-damping element that is attached to a tool.

FIG. 4 shows an alternative design of the vibration-decoupling of rotating part 3 designed as tool 16 from a not-shown intermediate element, which is located between rotating part 3 and bearing 7, 13. With this design, vibration-damping element 22 is attached to rotating part 3, which is designed as grinding disk 15, and establishes a connection with centering sleeve 25, which is designed as clamping sleeve 24. Centering sleeve 25 is clamped, e.g., in a fastening device 17, which is composed of a fastening flange 19 and a locknut 20, for attachment to a spindle 2. Vibration-damping element 22 is an inherently elastic, vibration-damping element 27 that is designed as an elastomeric element 26. Via this elastomeric element 26, a damping and/or decoupling of vibrations is attained between rotating part 3 designed as grinding disk 15 and intermediate element 21 designed as spindle 2, thereby resulting in the vibration-decoupling of rotating part 3 from the not-shown bearing of spindle 2.

Figure 5:
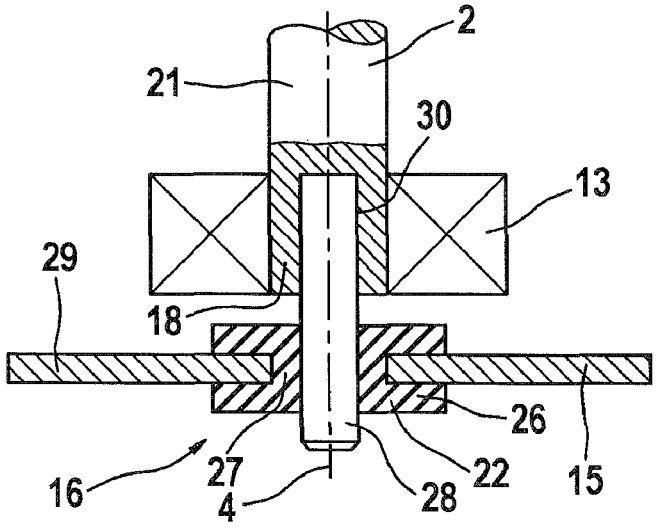
FIG. 5 shows a vibration-damping element that is integrated in the tool.

FIG. 5 shows an embodiment in which vibration-damping element 22 is integrated in tool 16. Tool 16 is composed of a tool shank 28, a tool element 29 designed as grinding disk 15, and vibration-damping element 22. Tool shank 28 of tool 16 is located along longitudinal axis 4 and is accommodated in end 18 of spindle 2. With this embodiment, only tool element 29 of tool 16 is rotating part 3. In this exemplary embodiment, spindle 2 is an intermediate element 21, similar to tool shank 28. End 18 of spindle 2 is enclosed radially by bearing 13, which is designed as ball bearing 12.

Figure 6:
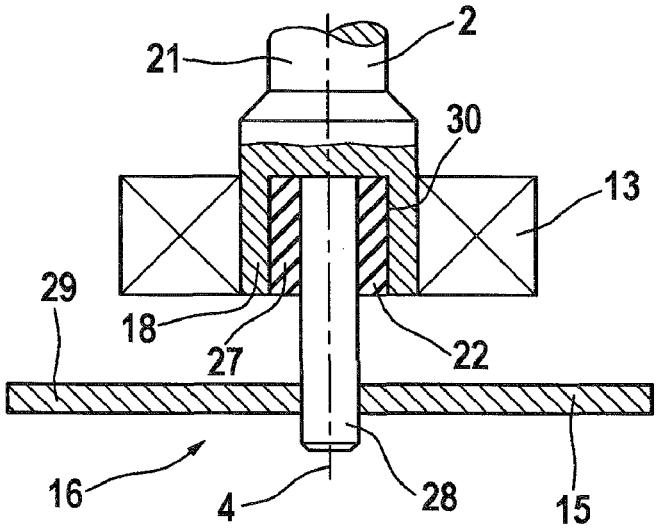
FIG. 6 shows a vibration-damping element that is located between a spindle and a tool shank.

FIG. 6 shows a tool 16, which is composed of a tool shank 28 and a tool element 29, and entire tool 16 forms rotating part 3. Tool shank 28 is accommodated in an axial recess of spindle 2 via an inherently elastic, vibration-damping element 27 located in a recess 30 of end 18 of spindle 2. With this embodiment, tool 16 is rotating part 3, and spindle 2 is an intermediate element 21.

Figure 7:
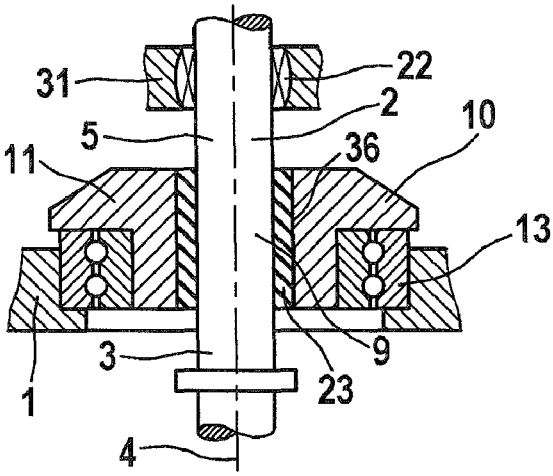
FIG. 7 shows a vibration-damping element that is located between a spindle and a crown wheel.

FIG. 7 shows the support of rotating part 3, which is designed as spindle 2, in a crown wheel 10 and a housing part 31. End 5 of spindle 2 is hingedly supported in housing part 31 via vibration-damping element 22. Central section 9 of spindle 2 is supported via vibration-damping element 23 in crown wheel 10 of a not-completely-shown bevel gear of an angle grinder. Crown wheel 10 is supported in transmission housing 1 via bearing 13 such that it is secured in the housing. Crown wheel 10 and spindle 2 are interconnected in a non-positive manner via vibration-damping element 23. A form-fit connection limits the freedom of motion between crown wheel 10 and spindle 2. Tool 16 is attached to spindle 2, e.g., via a not-shown fastening device. With this embodiment, spindle 2 is spindle 2, and tool 16 is rotating part 3.

Figure 8:
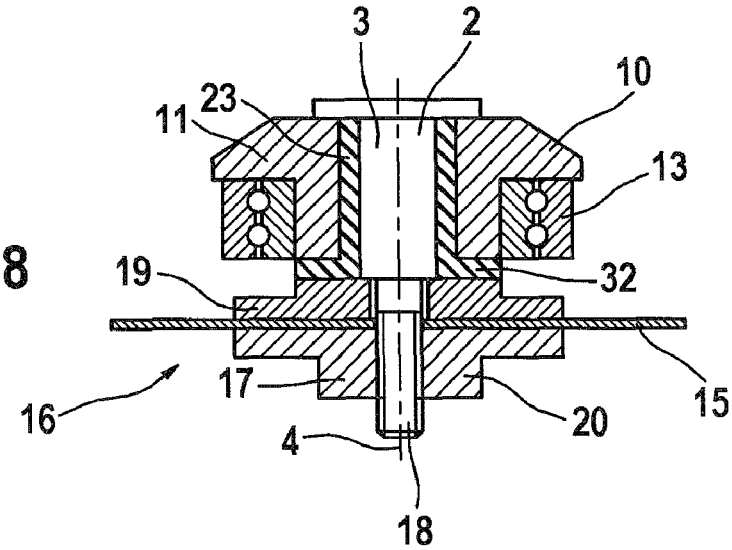
FIG. 8 shows a vibration-damping element that is located between a spindle and a crown wheel and a fastening device.

FIG. 8 shows spindle 2, which has been vibration-decoupled from bearing 13 of crown wheel 10 via damping element 23, on end 18 of which a grinding disk 15 is located that is attached via a fastening flange 19 and a locknut 20 (fastening device 17). Vibration-damping element 23 forms a collar 32 at one axial end, against which fastening flange 19 bears axially. Via this axial support, fastening device 17 is preloaded relative to crown wheel 10. With this embodiment, spindle 2, with fastening device 17 and tool 16 designed as grinding disk 15, form rotating part 3.

Figure 9:
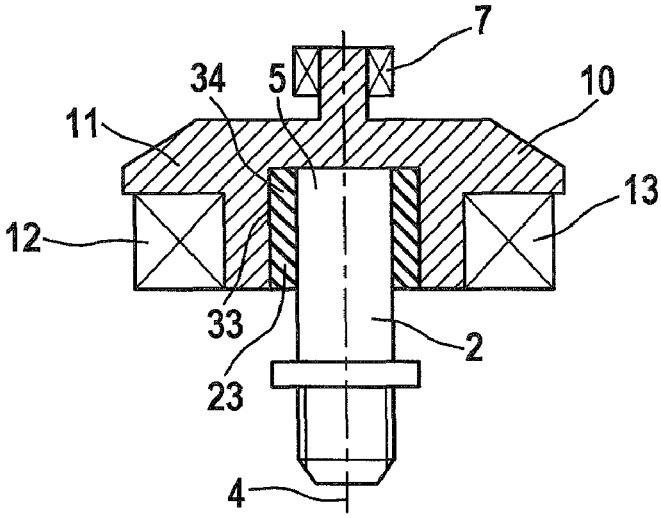
FIG. 9 shows a vibration-damping element that is located between a spindle and a crown wheel, which is supported at two points.

FIG. 9 shows an alternative support of rotating part 3, which is designed as spindle 2, in crown wheel 10. Crown wheel 10 is supported in transmission housing 1 via a bearing 13, which is designed as a needle roller bearing, and a further bearing 13, which is designed as a ball bearing 12. Spindle 2 is accommodated at end 5 via vibration-damping element 23 in an axial recess 33 in crown wheel 10. With this embodiment, vibration-damping element 23 serves simultaneously to decouple vibrations and establish a form-fit and non-positive connection between spindle 2 and crown wheel 10. To this end, vibration-damping element 23 is designed as a coupling device 34.

Figure 10A:
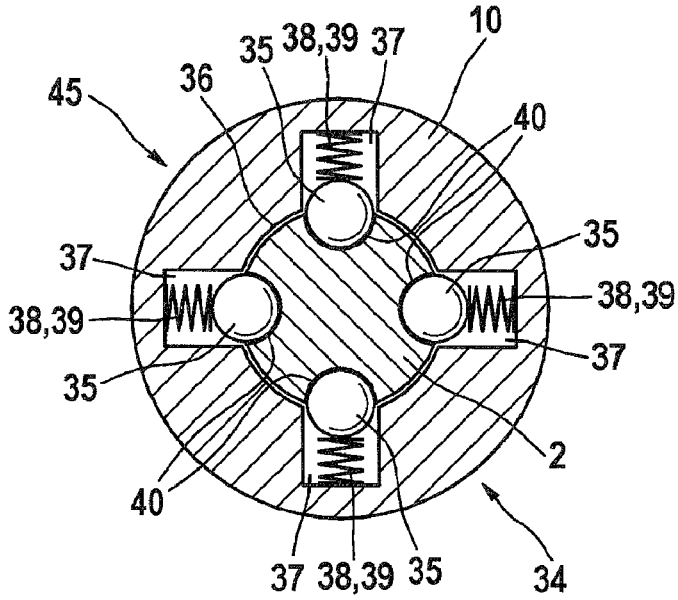
FIGS. 10A through 10C show possible embodiments of vibration-damping elements between a spindle and a crown wheel.
Figure 10B:
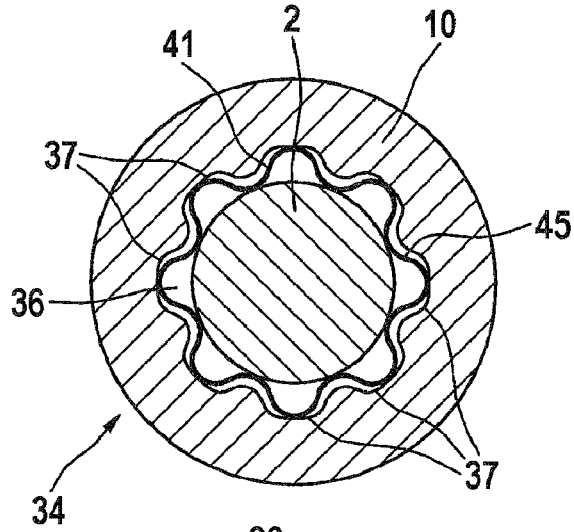
Figure 10C:
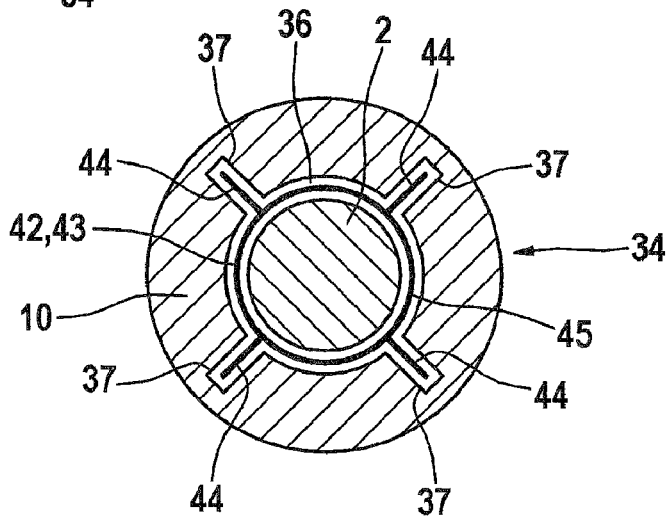

FIGS. 10A through 10C show three exemplary embodiments of coupling device 34, and the associated possibilities for a form-fit and non-positive connection between spindle 2 and crown wheel 10. In FIG. 10A, coupling device 34 is designed as a group of four spring-loaded balls 35 located between crown wheel 10 and spindle 2 in the circumferential direction. In its axial passage 36, crown wheel 10 includes several radially located recesses 37 at an axial level, in each of which a spring 39—designed as a compression spring 38—and a spring-loaded ball 35 are located. Spring-loaded balls 35 are guided through recesses 37 in crown wheel 10 and engage in corresponding recesses 40 in spindle 2. When the spindle is blocked, spring-loaded balls 35 may be displaced outwardly into recesses 37.

FIG. 10B shows a sectional view through spindle 2, which has been inserted into crown wheel 10, at the axial level of coupling device 34, which is designed as corrugated spring sleeve 41. Corrugated spring sleeve 41 has a wavy structure in the radial region, with which it engages in corresponding recesses 37 in crown wheel 10, thereby enclosing spindle 2 circumferentially.

FIG. 10C shows an embodiment of coupling device 34 as a sleeve 43 with spring tabs 44 that engage in corresponding recesses 37 in crown wheel 10. Sleeve 43 is designed, e.g., as sheet-metal sleeve 42. It encloses spindle 2, and spring tabs 44 engage radially outwardly in recesses 37 in crown wheel 10. With all coupling devices 34 shown in FIGS. 10A through 10C and designed as damping-spring devices 45, a form-fit and non-positive connection is produced between crown wheel 10 and spindle 2, and, simultaneously, vibrations are decoupled between these two elements.

As an alternative to damping-spring device 45, a knitted fabric may also be used, for example, which serves to establish a non-positive and form-fit connection, but which also dampens relatively small vibrational motions due to its inertia. As an alternative to using inherently elastic, vibration-damping elements 27, it is also possible to use liquid vibration-damping elements. Liquid vibration-damping elements refer, in particular, to damping cushions composed of an elastic sleeve and a filling of gel, liquid, or gas.

What is claimed is:

1. An electric hand-held power tool with at least one driven rotating part configured as a spindle that is supported in at least one bearing, and at least one intermediate element located between the bearing and the spindle, said intermediate element configured as a transmission element of a transmission, wherein the spindle is vibration-decoupled from the bearing via at least one vibration-damping element, which vibration-damping element is located between the transmission element and the spindle such that the spindle is supported by the transmission element via the vibration-damping element.

2. The electric hand-held power tool as recited in claim 1, wherein the vibration-damping element is attached to the spindle or the transmission.

3. The electric hand-held power tool as recited in claim 1, wherein the transmission element is a crown wheel of the transmission.

* * * * *